US011844479B2

(12) United States Patent
Milanese

(10) Patent No.: US 11,844,479 B2
(45) Date of Patent: Dec. 19, 2023

(54) DEVICE FOR THE HOT CLEANING OF VARIOUS TYPES OF SURFACES

(71) Applicant: Pier Antonio Milanese, Susegana (IT)

(72) Inventor: Pier Antonio Milanese, Susegana (IT)

( * ) Notice: Subject to any disclaimer, the term of this patent is extended or adjusted under 35 U.S.C. 154(b) by 199 days.

(21) Appl. No.: 17/274,899

(22) PCT Filed: Oct. 11, 2019

(86) PCT No.: PCT/IT2019/050219

§ 371 (c)(1),
(2) Date: Mar. 10, 2021

(87) PCT Pub. No.: WO2020/075209

PCT Pub. Date: Apr. 16, 2020

(65) Prior Publication Data

US 2022/0053992 A1 Feb. 24, 2022

(30) Foreign Application Priority Data

Oct. 12, 2018 (IT) ..... 102018000009426

(51) Int. Cl.
*A47L 13/256* (2006.01)
*A47L 11/40* (2006.01)
*A47L 13/22* (2006.01)

(52) U.S. Cl.
CPC ..... *A47L 13/256* (2013.01); *A47L 11/4075* (2013.01); *A47L 11/4086* (2013.01); *A47L 11/4088* (2013.01); *A47L 13/225* (2013.01)

(58) Field of Classification Search
CPC .... A47L 13/256; A47L 11/4086; A47L 11/34; A47L 11/4075; A47L 11/4088;
(Continued)

(56) References Cited

U.S. PATENT DOCUMENTS 7,891,047 B2 * 2/2011 Milanese ..... A47L 11/34 15/322
8,528,161 B2 * 9/2013 Vrdoljak ..... A47L 9/02 200/43.01

(Continued)

FOREIGN PATENT DOCUMENTS

CN 2436093 Y 6/2001
CN 106457319 A * 2/2017 ..... B08B 3/00

(Continued)

OTHER PUBLICATIONS

Translated document of CN-106457319-A (Year: 2022).*

(Continued)

*Primary Examiner* — Don M Anderson
*Assistant Examiner* — Sarah Akyaa Fordjour
(74) *Attorney, Agent, or Firm* — Maier & Maier, PLLC

(57) ABSTRACT

A device for hot cleaning of various types of surfaces, such as floors, tiled wall, large windows, mirrors, large household appliances, etc. The device includes a core body, including a steam generator and dispenser, suitable to generate steam under pressure and at high temperature, a metal heating plate with an heating element, a metal heated lower base to support and heat a cleaning cloth, a first valve, such as for example a solenoid valve, a second valve, such as for example a solenoid valve, a series of nozzles, a series of steam dispensers, and provided at the top with an articulated joint, a long hollow stiff thermally insulated element, such as a cylindrical tube, an ergonomic control and command system hollow along the length, and a hose.

5 Claims, 9 Drawing Sheets

(58) Field of Classification Search
CPC ..... A47L 13/22; A47L 13/225; B08B 3/00; B08B 3/04; B08B 2230/01; B08B 3/02
See application file for complete search history.

(56) References Cited

U.S. PATENT DOCUMENTS

| | | | | |
|---|---|---|---|---|
| 2007/0079470 | A1* | 4/2007 | Rippl | A47L 11/34 15/320 |
| 2007/0289087 | A1* | 12/2007 | Macleod | A47L 5/32 251/158 |
| 2014/0259510 | A1* | 9/2014 | Conrad | A47L 11/4008 15/322 |
| 2014/0359965 | A1 | 12/2014 | Hansen et al. | |

FOREIGN PATENT DOCUMENTS

| | | | |
|---|---|---|---|
| EP | 1 224 899 | A2 | 7/2002 |
| WO | 2006/097957 | A1 | 9/2006 |

OTHER PUBLICATIONS

International Search Report and Written Opinion dated Jan. 15, 2020 in corresponding International Application No. PCT/IT2019/050219; 4 pages.

* cited by examiner

DEVICE FOR THE HOT CLEANING OF VARIOUS TYPES OF SURFACES

FIELD

This invention refers to a device for the hot cleaning of various types of surfaces, such as floors, tiled walls, large windows, mirrors, large household appliances, etc.

At the state of the art, devices are known to clean floors with steam and including a handle, a core part and a lower brush that receives the steam from above produced by an instantaneous generator built into the core part of the device. Other similar devices are known equipped with instantaneous steam generators that can be removed from the core part and that are used for general cleaning with the support of various accessories such as brushes, pipe unions, cloths, etc.

BACKGROUND

The steam generated by such devices has a free flow, i.e. there is no pressure and the temperature it has when coming out of the brushes and/or the cloths is always below 100° C. with the consequent ineffectiveness in terms of cleaning and sanitisation of the treated surface. Moreover, such steam generators usually rapidly develop scale deposits that make them impossible to use very quickly.

Further devices for floor cleaning are known, which are usually called pull floor cleaning device, where the unit containing the steam generating boiler is located on a trolley and the lower brush and/or cloth for floor cleaning is not heated and is connected to such boiler by means of a hose and a stiff extension and the steam has much to run to reach the brush and/or the cleaning cloth and therefore the temperature of the steam reaching the brush and/or the cleaning cloth diminishes and the steam is no longer effective to clean the surfaces to treat.

In order to keep a suitable working temperature of the steam it must be generated in large quantities, thus causing high power consumption and the wear of all device components.

Such equipment too can be provided with accessories for the general cleaning of high surfaces such as walls or ceilings but since they are located on the floor on a trolley they are heavy and cannot be lifted, thus becoming uncomfortable to clean high surfaces like windows, bathroom walls, etc.

SUMMARY

This invention has the purpose to realise a hot cleaning device for various types of surfaces that can solve the problems described above.

This invention will be explained in the following description that provides only examples without any limitation and with reference to the following drawings, among which:

DETAILED DESCRIPTION OF THE EMBODIMENTS

Figure 1A:
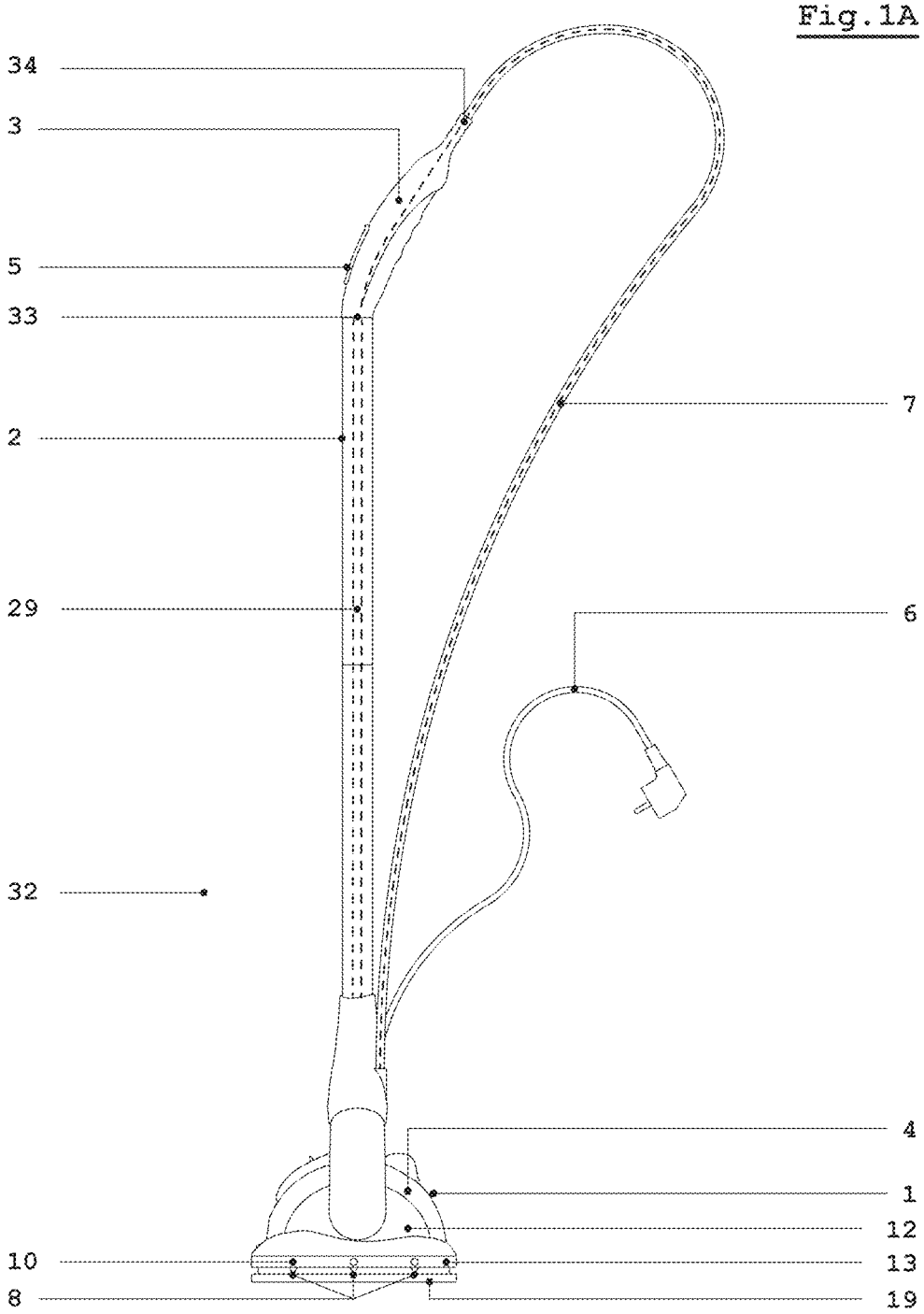
FIG. 1*a*, that shows a front view of the hot cleaning device for various types of surfaces, in one of its first working positions in compliance with the invention.
Figure 1B:
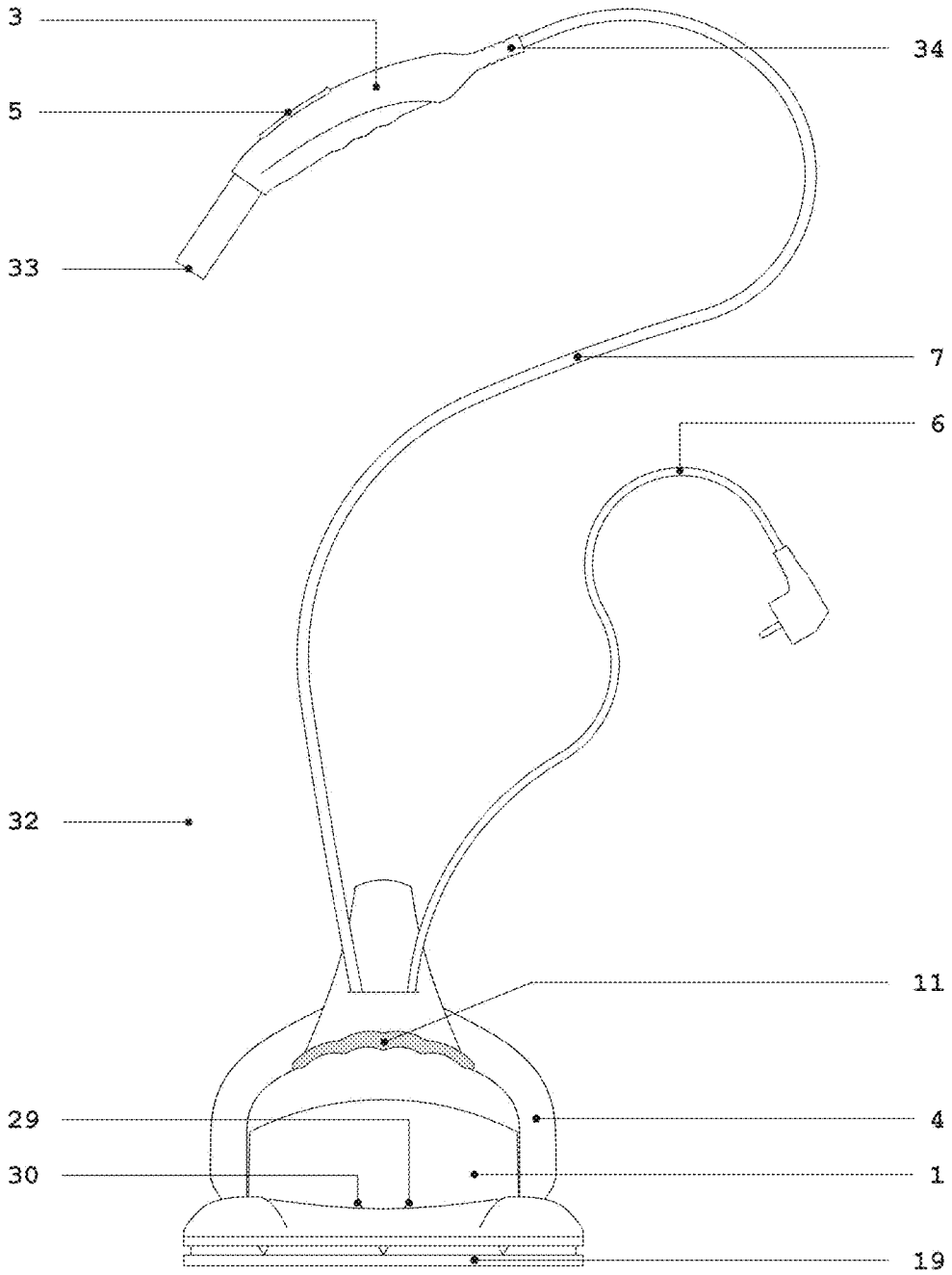
FIG. 1*b*, that shows a front view of the hot cleaning device for various types of surfaces, in a second working position in compliance with the invention.
Figure 2:
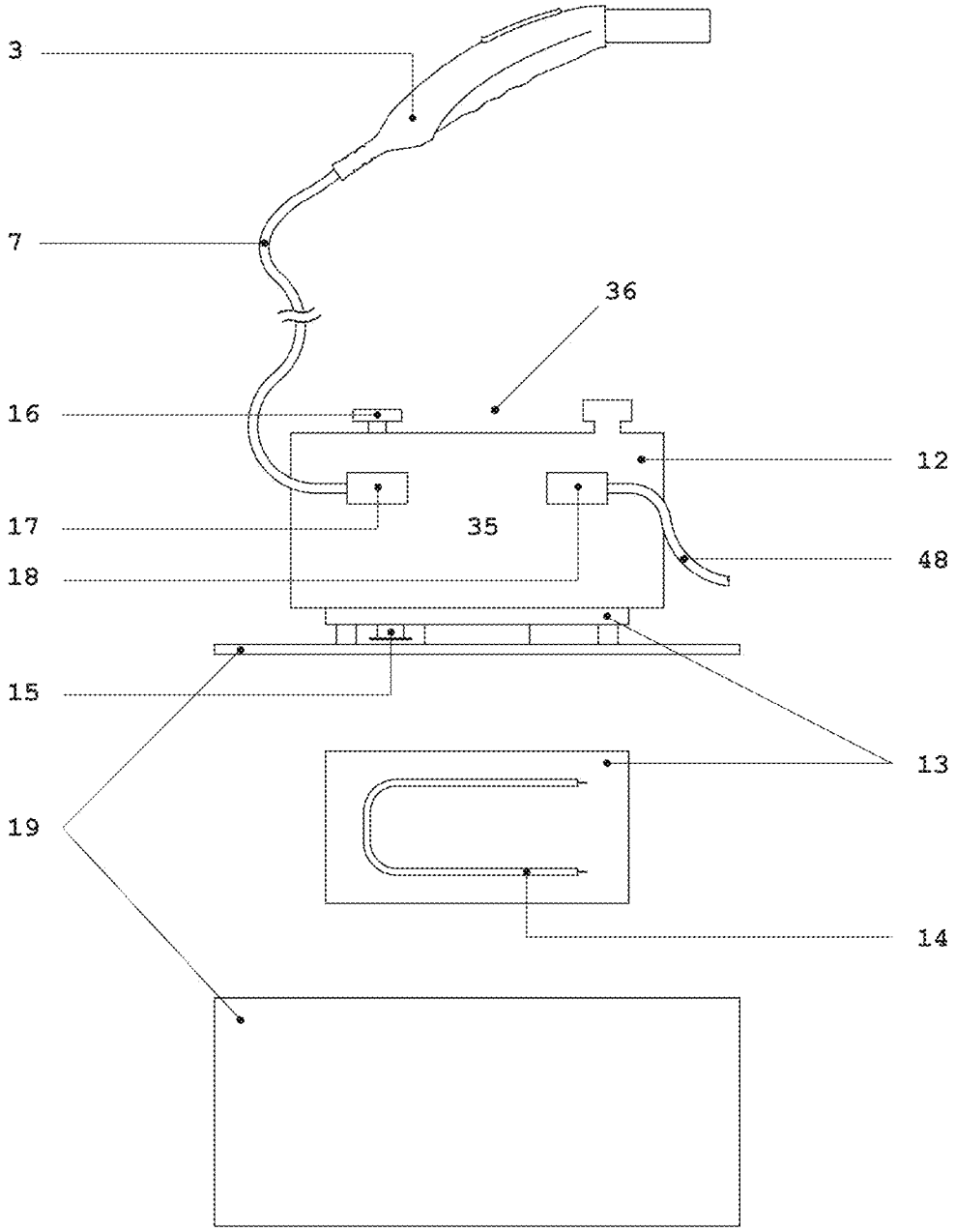
FIG. 2, that shows the scheme of a group of device components shown in FIGS. 1*a*-1*b;*
Figure 4:
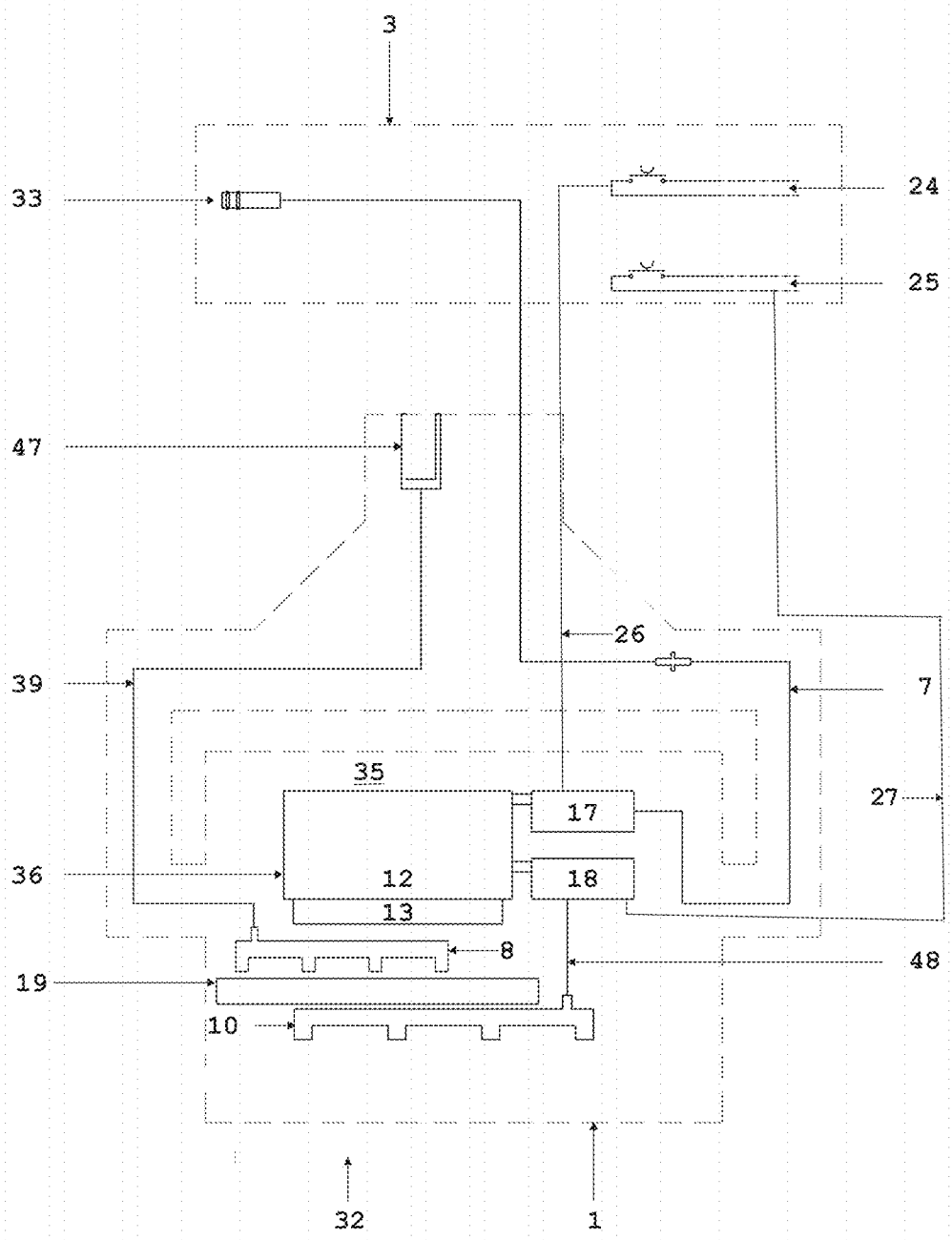
FIG. 4, that shows a diagram of the steam circuit of the device shown in FIGS. 1*a*-1*b*, in compliance with the invention.

This invention refers to a device for the hot cleaning of different types of surfaces such as floors, tiled walls, large windows, mirrors, large household appliances, etc., and this device (32), as it can be easily seen in FIGS. 1*a*, 1*b* and 4, is substantially made of a core body (1), that contains a first group of elements that will be described below and provided above with an articulated joint with a handle (4) to an upper opening of which (47) a long hollow stiff thermally insulated element (2) is connected in a going-through and removable way such as for example a cylindrical tube connected at the top in a going-through and removable way to a first end (33) of an ergonomic means of control and command longitudinally hollow (3), such as for example a handle equipped with at least a pushbutton and/or a horizontally pivoted control (5), and a hose (7) connected by means of its upper end in a going-through way to its other end (34), and that connects it in a going-through way to said core body (1).

Said core body (1) is substantially made of a steam generator and dispenser (35), connected below to a heating metal plate (13), that on its turn is connected at the bottom to a heated lower base (19), made of metal like aluminium for example, to which the cleaning cloth is applied (not shown).

Such heating plate (13) is equipped with a heating element (14) and a safety thermostat (15).

Said steam generator and dispenser (35) consists of a boiler to produce steam (36), that includes a water tank (12), connected at the bottom to such heating base (13), a pressure gauge (16) to adjust the steam temperature and pressure inside such boiler (36), that automatically starts and stops the heating element (14) to keep the steam pressure inside the boiler at the pre-set value (36), while the safety thermostat (15) turns on in case of failure of the pressure gauge (16), by cutting off the power supply to the heating element (14), thus saving the other components of the core body, such boiler (36) including at least two valves (17 and 18), preferably solenoid valves, for the functions that will be described below and the first valve is connected to the bottom of the pipe (7) while the second one is connected to a series of front nozzles (10) through a hose (48) located below in the front part of such core body (1).

Said core body (1) finally includes a series of steam dispensers (8), connected to the pipe inlet (2) and in direct contact with the cloth (not shown) fastened to the heated plate (19).

Such pipe (7) consists of an external insulating cover (31) hosting inside a rubber hose (28) to let the steam go through and some insulated electric conductors (26, 27), and such rubber hose (28) extends up to the first end (33) of the handle (3), while the electric conductors (26, 27) connect the two solenoid valves (17, 18) with the corresponding start and stop pushbuttons (24, 25), that can be operated through their controls (5).

The functioning of the cleaning device (32) is now briefly described as well as the interaction between its various components.

After turning on the cleaning device (32) by connecting it to the power grid by means of an electric cable (6) or a battery (not shown) fastened to it and the controls already known, the boiler (36) heats the water inside the tank (12) until it reaches the set temperature, for ex. 130° C., and the heated plate (19) is heated to the same temperature by the heating element (13), while the lamps (29 and 30) show that the device is powered and that such temperature has been reached.

Figure 3:
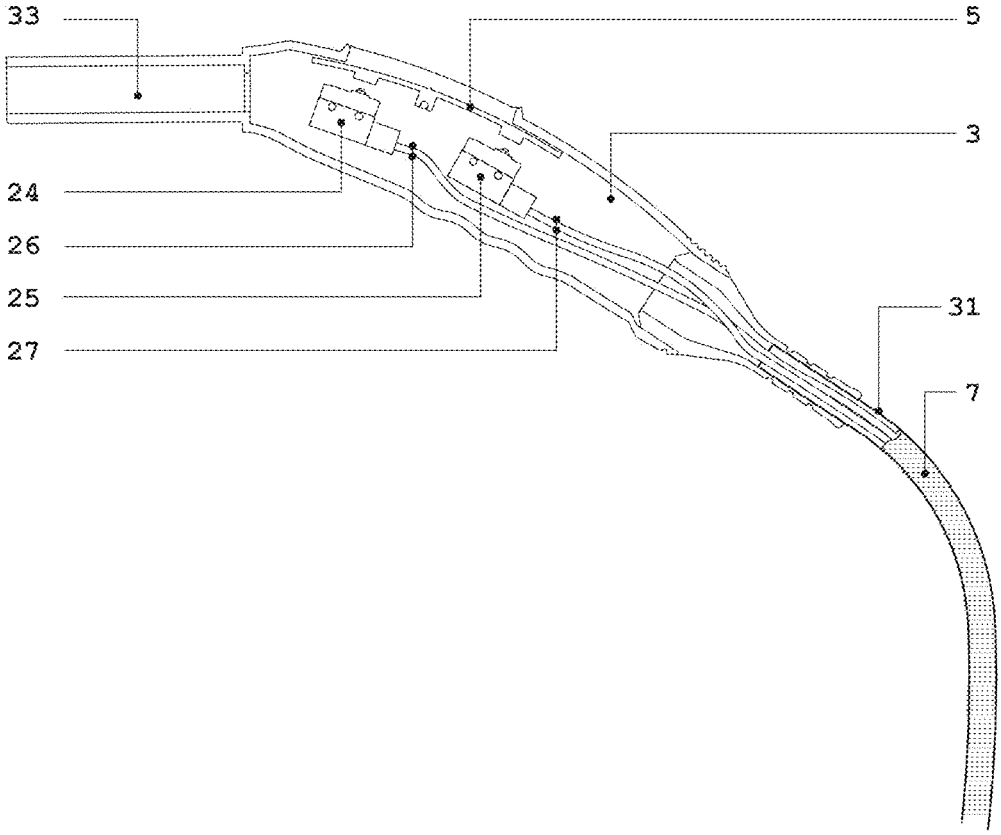
FIG. 3, that shows a section side view of a device component shown in FIGS. 1*a*-1*b*, in its resting position.
Figure 3A:
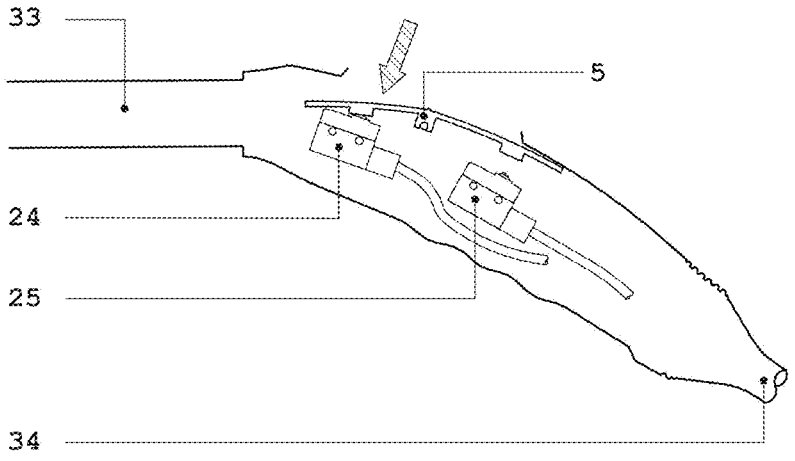
FIG. 3*a*, that shows a section side view of the element in FIG. 3, in its first working position.
Figure 3B:
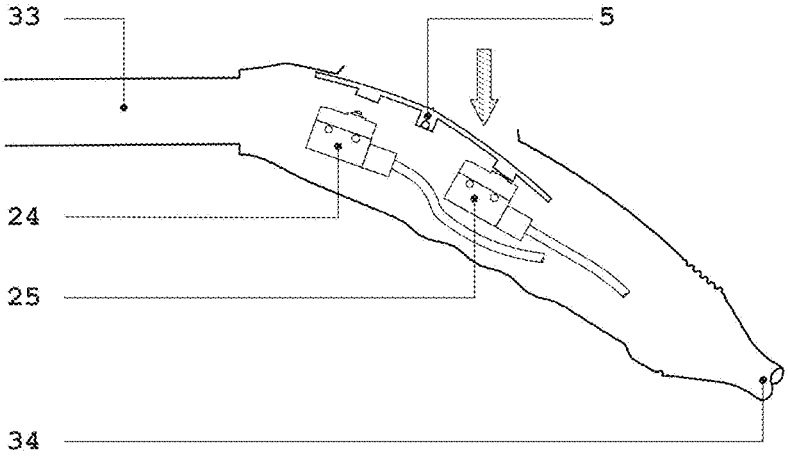
FIG. 3*b*, that shows a section side view of the element in FIG. 3, in its second working position.

In the first working position of the device (32) (see FIG. 1*a*), where the handle (3) is fitted into the tube (2), from a resting position of the same handle (3) (see FIG. 3), the switches are operated separately or all at the same time (24, 25) by using the control (5), in particular by operating the first switch (24), through the electric connection (26), the first solenoid valve is opened (17), so that the steam produced by the generator (35) coming out of the boiler (36) at the pressure set with the pressure gauge (16), first goes through the pipe (28), then through the thermally insulated tube (2) and the upper opening (47) of the core body (1) then reaches through another pipe (39) the steam dispensers (8), that blow it directly on the cleaning cloth (not shown), whose temperature is kept stable by the heated plate (19), thus being able to clean surfaces like floors with a suitable temperature for an effective cleaning and sanitisation, while when operating the second switch (25), by means of the second electric connection (27), the second solenoid valve is opened (18) so that the steam generated in the boiler (36) reaches the nozzles (10), at the temperature set with the pressure gauge (16), through a tube (38), and the steam can be sprayed directly on the surface to clean with greater cleansing and sanitisation effect.

To stop the steam release the control (5) is used, thus stopping one or both solenoid valves (17, 18).

Figure 3C:
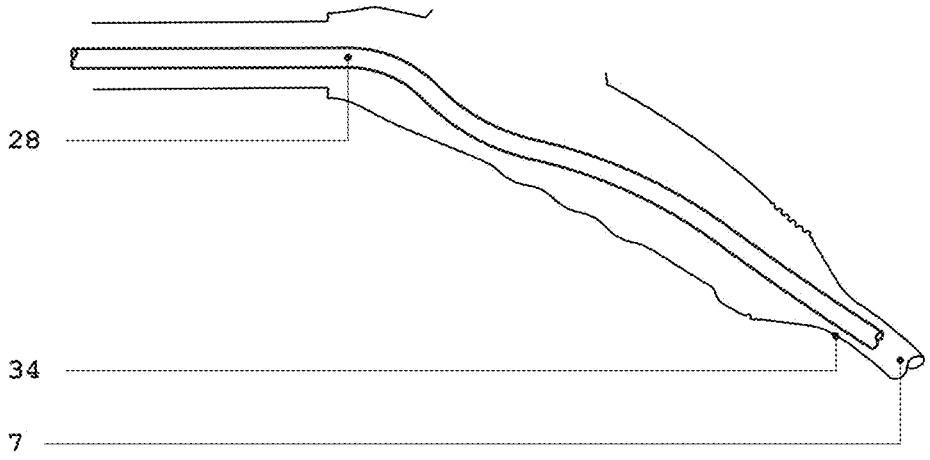
FIG. 3*c*, that shows a section side view of the element in FIG. 3, with other components.

In the second working position of the device (32) (see FIG. 1*b*), the tube (2) is separated from the core body (1), so that the core body (1) is easy to move thanks to the articulated joint with handle (4), that can have for example the shape of a fork and it is lightweight, while when taking the handle with the hand (3) and operating the switch (24), the steam generated in the boiler (36) gets at the pressure set with the pressure gauge (16), through the hose (28) to the first open end (33) and comes out at the same pressure (see FIG. 3*c*), thus making it possible to clean and sanitise surfaces at different heights like walls, ceilings, hanging furniture or inside household appliances like ovens. To stop the release of steam the switch (24) is turned off through the control (5).

Figure 5:
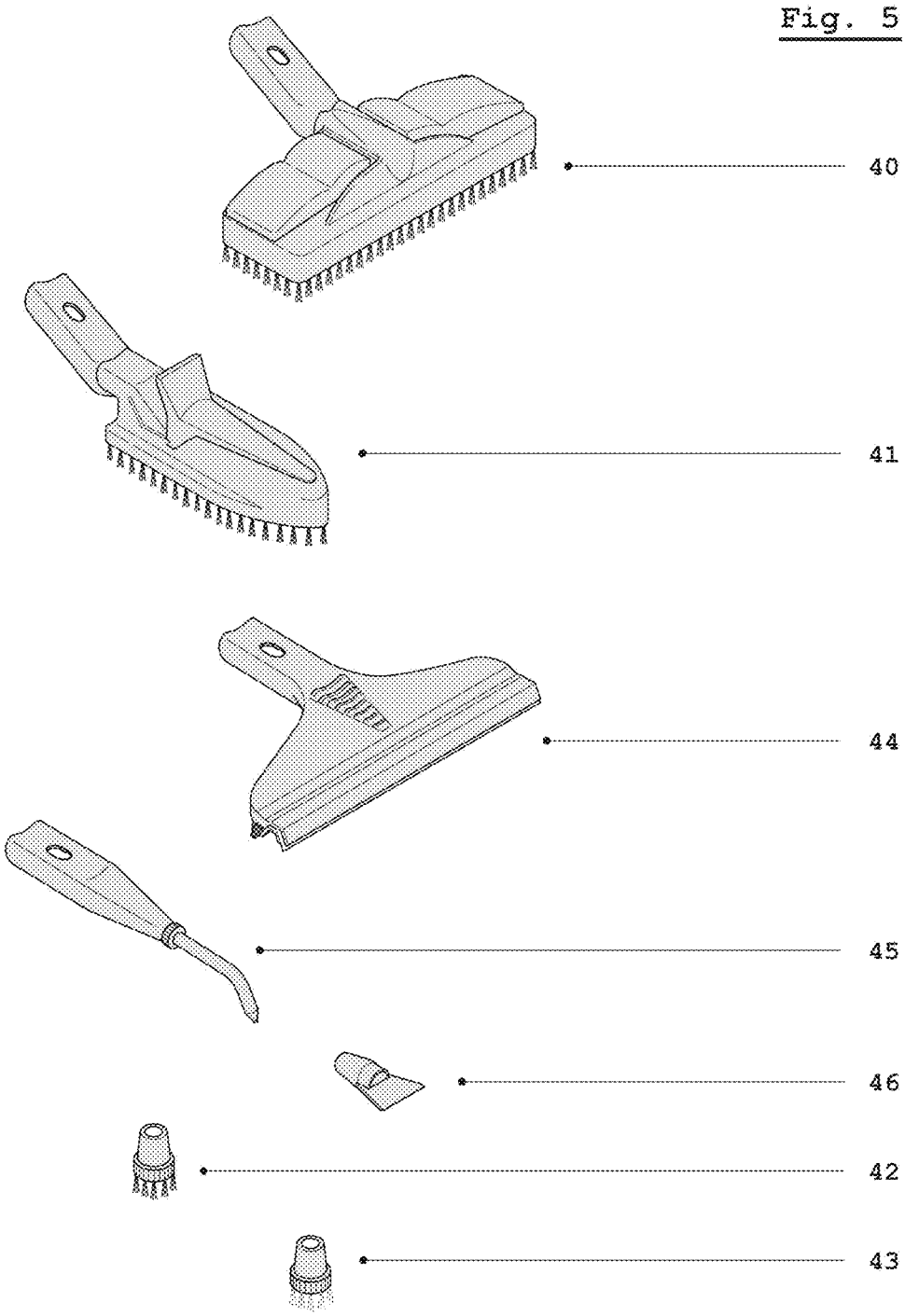
FIG. 5, that shows a prospect view of different accessories that can be used with the device in its second working position in compliance with the invention.

The first open end (33) of the handle (3) can host in a removable way and by inserting them, accessories like those shown in FIG. 5, brushes of different shapes and sizes (40, 41, 42, 43), window wiper (44), jet dispenser (45), spatula dispenser (46), or by using the tube (2).

This innovation is very important because the steam coming from the boiler does not cool down when reaching the cleaning cloth and therefore keeps its temperature for an effective cleaning and sanitising of the floor, moreover the quantity of steam is drastically reduced because the temperature of the cleaning cloth is kept high by the aluminium plate on which it lies and it is therefore not necessary to release a lot of steam to keep the necessary temperature. A further advantage is that the boiler autonomy is largely increased and the cloth is not too wet as usually happens in the existing devices.

The invention claimed is:

1. A hot cleaning apparatus for various surfaces, the apparatus comprising a main body, including a steam generating and delivering means adapted to produce steam and pressure and high temperature, and, on a top part thereof, a jointed joining part, said apparatus further comprising:

a lengthened hollowed stiff element;

a longitudinally hollowed control and command means equipped with at least a pushbutton and/or a command tilting key adapted to actuate two actuating switches;

a first valve means;

a flexible pipeline connected with an upper end portion of the flexible pipeline to a second end portion of the control and command means, and, with a lower end portion of the flexible pipeline, to the main body through the first valve means;

a metallic heating plate with an electric heating element;

a metallic lower heated base for supporting and heating a cleaning cloth connected to the metallic heating plate;

a second valve means;

a plurality of nozzles; and a plurality of steam spreaders;

wherein said lengthened hollowed stiff element is thermally insulated and joined in a communicating and removable way with a lower part of the lengthened hollowed stiff element to an upper opening of the main body, and with an upper part of the lengthened hollowed stiff element, in a communicating and removable manner, to a first end portion of the longitudinally hollowed control and command means, wherein said flexible pipeline is formed by an external insulating jacket in which there are present at least a pipe, made of rubber, for the passage of the steam, and insulated electrical conductors, of which said rubber pipe continues up to the first opened end portion of the handle-grip, whereas the electrical conductors connect the first valve means and the second valve means with the respective actuating switches, wherein said metallic heating plate with electric heating element and said metallic heated lower base are arranged in contact with and in succession below said steam generating and delivering means, said steam spreaders being arranged in the main body and oriented towards the cleaning cloth supported by the heated plate and being connected at its inlet with the upper opening of the main body, wherein said actuating switches are adapted to open and/or to close the first valve means and the second valve means, respectively, in a selective or simultaneous way, wherein the hot cleaning apparatus is configured in such a way that the steam generated by the steam generator means, when the first valve means is opened, if the control and command means is joined to the lengthened hollow element, passes through the flexible pipeline, the control and command means, the lengthened hollow element, the upper opening, and the spreaders and arrives to the cleaning cloth supported by the heated plate; or, if the control and command means is not joined to the lengthened hollowed element, the steam passes through the flexible pipeline, the control and command means and goes out from the first opened end portion thereof, whereas, when the second valve means is opened, and the first valve means is opened, the steam generated by the steam generator arrives also to the plurality of nozzles for a direct jet on the surface to be cleaned, and when the second valve means is opened, and the first valve means is closed, the steam generated by the steam generator arrives only to the plurality of nozzles for a direct jet on the surface to be cleaned.

2. Cleaning apparatus according to claim 1, wherein said steam generating and delivering means comprise a boiler, a water container and a pressure switch, said pressure switch for regulating the temperature and the pressure of the steam into said boiler being adapted to activate or to deactivate automatically the electric heating element for maintaining at the pre-set level the pressure of the steam into the same boiler.

3. Cleaning apparatus according to claim 1, wherein said metallic heating plate is provided with a security thermostat, which operates in case of failure of the pressure switch by cutting off the power supply to the heating element.

4. Cleaning apparatus according to claim 1, wherein the jointed joining part is a holdable type.

5. Cleaning apparatus according to claim 1, wherein additional elements are fixed in a removable way by inserting to the first opened end portion of the handle, said additional elements comprising brushes of different shape and sizes, a window washer, a jet delivering element, a spatula delivering element, or the pipe detached from the main body in advance.

* * * * *